United States Patent [19]

Peters

[11] 4,427,234

[45] Jan. 24, 1984

[54] LEG REST

[76] Inventor: Douglas A. Peters, 4 Grandor Ct., West Hill, Ontario, Canada, M1E 1E1

[21] Appl. No.: 251,898

[22] Filed: Apr. 7, 1981

[51] Int. Cl.[3] ..... A47C 9/12

[52] U.S. Cl. ..... 297/439; 297/437

[58] Field of Search ..... 297/439, 438, 423, 437, 297/432; 5/444, 443

[56] References Cited

U.S. PATENT DOCUMENTS

| | | | |
|---|---|---|---|
| 1,740,267 | 12/1929 | Remington | 297/437 X |
| 2,177,174 | 10/1939 | Eccles | 297/437 |
| 2,248,369 | 7/1941 | Ludersen | 297/439 X |
| 2,600,759 | 6/1952 | Gross | 297/439 |
| 3,606,458 | 9/1971 | Attinger | 297/439 |

FOREIGN PATENT DOCUMENTS

| | | | |
|---|---|---|---|
| 59051 | 12/1953 | France | 297/439 |
| 67173 | 2/1914 | Switzerland | 297/439 |

*Primary Examiner*—Francis K. Zugel

*Attorney, Agent, or Firm*—Ridout & Maybee

[57] ABSTRACT

A leg rest comprises a first support adapted to fit under the knees of a person seated in a chair, a second lower support adapted to receive the feet of the person, and a spacer extending between the supports whereby the spacing between the supports may be adjusted. The spacer is hinged to allow the second support to be swung against the first support when not in use. The second support may be contained within the first support for storage.

6 Claims, 2 Drawing Figures

LEG REST

LEG REST

This invention relates to a leg rest for sustaining the legs and feet of a person in a raised and comfortable position when seated on a sofa or chair.

Various leg rests have been proposed heretofore but have been bulky, or have provided only limited support, or have suffered from other drawbacks.

The present invention provides a leg rest comprising a first support adapted to fit under the knees of a person seated in a chair, a second, lower support adapted to receive the feet of said person, and a spacer to extend between the supports and having means for adjusting the spacing between the supports.

The leg rest may be arranged to fold, and to be compactly stored.

A preferred embodiment of the invention is illustrated in the accompanying drawings in which.

Figure 1:
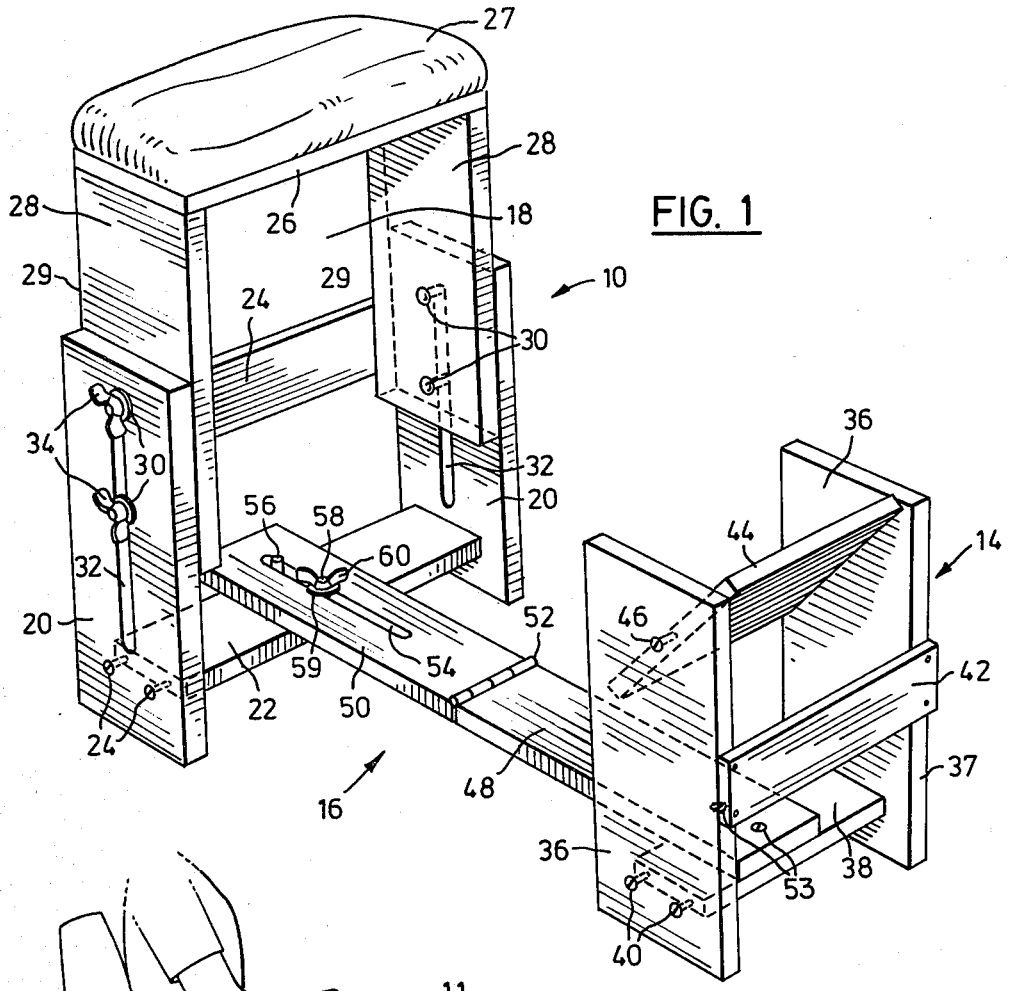
FIG. 1 is a perspective view of a leg rest.

Referring to the drawings in detail, wherein like reference numerals refer to similar parts, there is illustrated a leg rest which consists of three main components: a vertically adjustable first support 10, adapted to be positioned under the knees of a person 11 seated in a chair or sofa 12, a second, smaller support 14, adapted to be positioned under the feet of the person, and a spacer 16, extending between the first and second supports.

The first support 10, comprises a 2-part upright rectangular frame defining an enclosure 18 adapted to contain the second support 14, therein for storage.

A pair of flat elongated sides 20, positioned to stand erect, are spaced apart laterally in a face-to-face relationship.

A flat base 22, extends horizontally between the sides near their lower ends, and is rigidly attached thereto by screws 24.

An adjustable top 26, having a padded covering 27 attached to its upper surface, is positioned horizontally above the sides 20. A pair of flat supporting members 28, are rigidly attached at the ends of the top 26, to extend in a downwardly direction therefrom in a face-to-face relationship to one another, and are spaced apart to a distance suitable to conform to the interior spacing of the sides 20, whereby the top 26 may be positioned between the sides 20, and may freely slide vertically between them.

A pair of vertically spaced studs 30 are fitted into each supporting member, and positioned to extend outwardly therefrom. Vertical slots 32 formed in the sides 20 are adapted to receive the studs, the distal ends of which project therefrom.

Wing nuts 34 are threaded onto the ends of the studs, for tightening the support members to the sides at a desired elevation.

A flat brace 25, extending horizontally between support members 28, abuts their outward-facing edges 29, and is rigidly fastened thereon.

The second support 14, comprises a pair of sides 36, spaced apart laterally and positioned to stand erect in a face-to-face relationship. The support 14 has exterior dimensions suitable to permit it to be contained in the enclosure 18. A flat base 38, extends horizontally between the sides 36, near their lower ends, and is rigidly attached thereto by screws 40. A flat brace 42, extending horizontally between sides 36, at an intermediate height, abuts the outward facing edges 37, of the sides, and is rigidly fastened thereon. A tiltable footrest 44, is mounted on studs 46, journalled in the sides 36, at a suitable height, for pivotal movement about a horizontal axis.

An elongated spacer 16, extends between the supports 10 and 14, and comprises two members, 48 and 50, joined longitudinally together by an intermediate hinge 52, each member having at its opposite end means for attachment thereof to the supports 10 and 14, respectively, as follows: member 48 is rigidly attached to the mid-section of the base 38 by a pair of studs 53; member 50, has a slot 54 formed longitudinally therein; and the base 22 has a dowel 56, and a threaded stud 58, protruding upwardly from its mid-section; the dowel and stud are spaced apart longitudinally, relative to the slot 54. The dowel and stud fit into the slot, permitting the spacer 16 to be slid back and forward longitudinally. A washer 59, and wing nut 60, are placed on the stud to permit the spacer to be tightened to the base 22, in a desired position.

Figure 2:
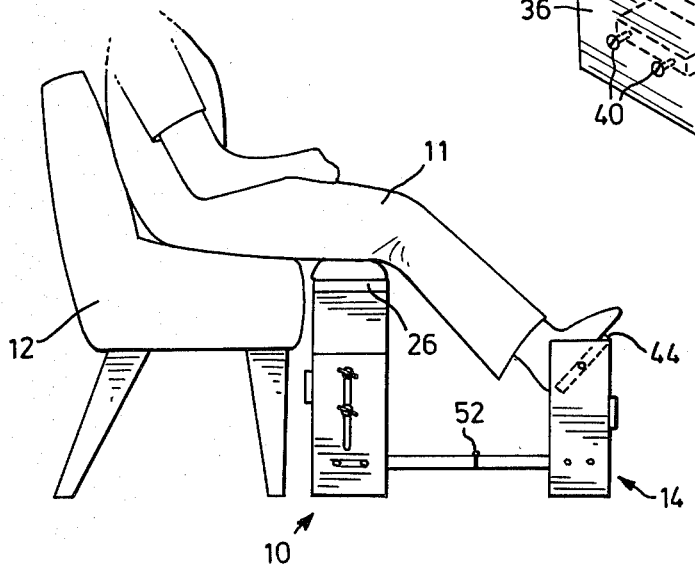
FIG. 2 is a side view on a reduced scale showing how the leg rest may be used.

FIG. 2 shows the assembled leg rest positioned in proximity to the seat of a chair, so that the first support 10 is nearest the seat, and the top 26, is adjusted to a suitable height to fit under the knees of the user.

The second support 14 is placed in front of the first support and at a suitable distance therefrom, and secured by means of the wing nut 60. The tiltable footrest 44 will support the feet of the user, and will pivot easily by foot pressure to a suitable angle.

The second support 14, may be swung, by means of the hinge 52, to a position adjoining the first support 10, in order to reduce the size of the leg rest when it is not in use for short periods of time, or to facilitate carrying it. For storage, or transportation of the leg rest, the spacer 16 may be detached by removing the studs 53 and the wing nut 60 and washer 59.

The second support 14, may then be placed into the enclosure 18, of the first support. The spacer 16 can also be folded for storage.

What I claim as my invention is:

1. A leg rest comprising a first support adapted to fit under the knees of a person seated in a chair, a second, lower support adapted to receive the feet of said person, a spacer extending between the supports and detachable therefrom having means for adjusting the spacing between the supports, and means within the first support for storing the second support therein.

2. A leg rest as claimed in claim 1, wherein the means within the first support comprises a frame defining an enclosure adapted to contain the second support therein for storage.

3. A leg rest as claimed in claim 1, in which the spacer comprises two members joined by a hinge whereby the second support can be swung into proximity to the first support to reduce the size of the leg rest when not in use and facilitate carrying it.

4. A leg rest as claimed in claim 1 or 3, wherein the second support has a foot rest that is tiltable to suit the angle of said person's feet.

5. A leg rest as claimed in claim 1 or 3, in which the first support is vertically adjustable.

6. A leg rest comprising a first rectangular frame having a base, sides, and a top that fits under the knees of a person seated in a chair, with means for adjusting the elevation of the top, a second rectangular frame having a base, sides and a tiltable top to constitute a footrest, an elongated spacer to extend between the frames, means for rigidly fixing the spacer to one of the bases, means of adjustably fixing the spacer to the other of the bases to adjustably open the frames apart, the spacer having an intermediate hinge about which the second frame can be swung to a position adjoining the first frame, and the second frame when detached from the spacer being storable within the first frame.

* * * * *